US011116340B2

(12) United States Patent
Cicarelli

(10) Patent No.: US 11,116,340 B2
(45) Date of Patent: Sep. 14, 2021

(54) CONTAINER WITH LAMINAR FLOW

(71) Applicant: James Cicarelli, Brigantine, NJ (US)

(72) Inventor: James Cicarelli, Brigantine, NJ (US)

( * ) Notice: Subject to any disclaimer, the term of this patent is extended or adjusted under 35 U.S.C. 154(b) by 180 days.

(21) Appl. No.: 16/408,964

(22) Filed: May 10, 2019

(65) Prior Publication Data

US 2019/0261793 A1 Aug. 29, 2019

Related U.S. Application Data

(62) Division of application No. 14/967,538, filed on Dec. 14, 2015, now abandoned.

(60) Provisional application No. 62/164,942, filed on May 21, 2015.

(51) Int. Cl.
*A47G 19/22* (2006.01)
*B67C 3/26* (2006.01)

(52) U.S. Cl.
CPC ..... *A47G 19/2233* (2013.01); *A47G 19/2227* (2013.01); *A47G 2019/2238* (2013.01); *B67C 3/26* (2013.01); *B67C 2003/266* (2013.01); *B67C 2003/268* (2013.01); *B67C 2003/2671* (2013.01); *B67C 2003/2674* (2013.01); *B67C 2003/2677* (2013.01)

(58) Field of Classification Search
CPC ..... A47G 19/2233; A47G 19/2227; A47G 2019/2238; B67C 3/26; B67C 2003/268; B67C 2003/2677; B67C 2003/2671; B67C 2003/266; B67C 2003/2674
See application file for complete search history.

(56) References Cited

U.S. PATENT DOCUMENTS 3,256,916 A * 6/1966 Silletti ..... A47G 19/2205 141/286
3,735,113 A 5/1973 Stott
4,050,484 A * 9/1977 Danyo ..... B67C 11/02 141/34
4,126,164 A * 11/1978 Magnifico ..... A47G 19/2205 141/100
4,800,934 A * 1/1989 Boissoneault ..... B67C 11/02 141/106
7,182,110 B2 * 2/2007 Roebuck ..... B65B 3/36 141/244
7,997,305 B2 * 8/2011 Haramis ..... A47G 19/2205 141/100
8,505,442 B2 8/2013 Ishida et al.
(Continued)

*Primary Examiner* — Nicolas A Arnett
(74) *Attorney, Agent, or Firm* — Laubscher & Laubscher P.C.

(57) ABSTRACT

A container such as a beverage container is characterized by a device arranged within the container to impart a laminar flow to a fluid being poured or dispensed within the container. The laminar flow device is arranged in either the central portion of the container or in a side wall of the container. In a preferred embodiment, the flow device includes a plurality of flutes which slow the flow of the beverage into the container. In addition, the container bottom wall is preferably concave to provide a smooth transition for the flow of beverage from the laminar device to the container bottom and up the interior of the container during filling. The laminar device reduces the formation of foam within the fluid during filling of the container. A flow director is also provided for connecting a fluid dispenser with the laminar flow device.

12 Claims, 4 Drawing Sheets

(56) References Cited

U.S. PATENT DOCUMENTS

| | | | | |
|---|---|---|---|---|
| 8,726,948 | B2 * | 5/2014 | Haramis | A47G 21/00 141/100 |
| 8,875,753 | B2 * | 11/2014 | Norris | A47G 21/00 141/333 |
| RE45,935 | E * | 3/2016 | Taufer | A47G 19/06 |
| 10,899,507 | B2 * | 1/2021 | Macrellino | A47G 19/12 |
| 2004/0177893 | A1 | 9/2004 | Younkle | |
| 2006/0021986 | A1 | 2/2006 | Mansfield et al. | |
| 2011/0277884 | A1 | 11/2011 | Kirschenbaum | |

* cited by examiner

CONTAINER WITH LAMINAR FLOW

This application is a division of U.S. application Ser. No. 14/967,538 which was based on U.S. provisional application No. 62/164,942 filed May 21, 2015.

BACKGROUND OF THE INVENTION

When dispensing fluids into a container, and especially carbonated beverages, the fluid has a tendency to create excess foam within the container. For example, when dispensing draft beer from a pressurized container such as a keg or a carbonated soft drink from a bottle, the carbonation creates foam in the glass or plastic cup. While a little foam may enhance the flavor of the beer, excessive foam becomes a very expensive waste issue to owners and operations serving draft beer. In most situations, the user will not wait until the foam dissipates before finishing pouring of the beer. The foam is typically poured off the side of the glass, disposed of by the user, and then more of the beverage is poured to fill the container. This not only increases the time required to pour the beverage, but depending on the technique used, it will still generate more foam waste.

There are many practices to pour a beverage to minimize or reduce turbulence of volatile beverages, none of which can be considered to be the correct practice. This is particularly troublesome in an environment where there are many bartenders and a large number of customers. The ultimate desire is to minimize the time required to serve each customer but also reduce excess foaming.

The present invention was developed in order to overcome this drawback by providing a container which not only maintains a laminar flow of carbonated beverages while being poured but also standardizes the pouring technique of carbonated beverages by using only one method. The container maintains a laminar flow, thereby reducing foaming and waste.

SUMMARY OF THE INVENTION

Accordingly, it is a primary object of the invention to provide a container including a housing having a closed bottom wall, a side wall, and an open upper end defining a chamber. A laminar flow device is arranged within the housing chamber and receives fluid dispensed, deposited, or poured into the chamber. The device further directs the fluid toward the chamber bottom while minimizing turbulence to minimize the formation of foam within the fluid.

In a preferred embodiment, the laminar flow device is a projection extending from a central portion of the bottom wall toward the open upper end. The projection preferably has a tapered conical configuration and a diameter that narrows in the direction of the housing upper end. A lower portion of the projection may be fluted to increase the surface area of the projection and increase the laminar effect of the fluid dispensed into the container. The fluted portion of the projection preferably has a star-shaped cross-sectional configuration.

In an alternate embodiment, the laminar flow device is a fluted portion of an inner surface of the side wall which has a star-shaped cross-sectional configuration. The diameter of the fluted portion narrows in the direction of the housing upper end. A projection is also provided which extends upwardly from a central portion of the bottom wall.

The bottom wall has a concave configuration to aid in dispersing the fluid within the container with minimal disturbance.

According to a further object of the invention, a flow director is provided which fits into the nozzle of a fluid dispenser such as the spigot of a beer tap and which mates with the upper end of the laminar flow device. The flow director includes an annular passage which directs fluid from the spigot to the exterior surface of the laminar flow device.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
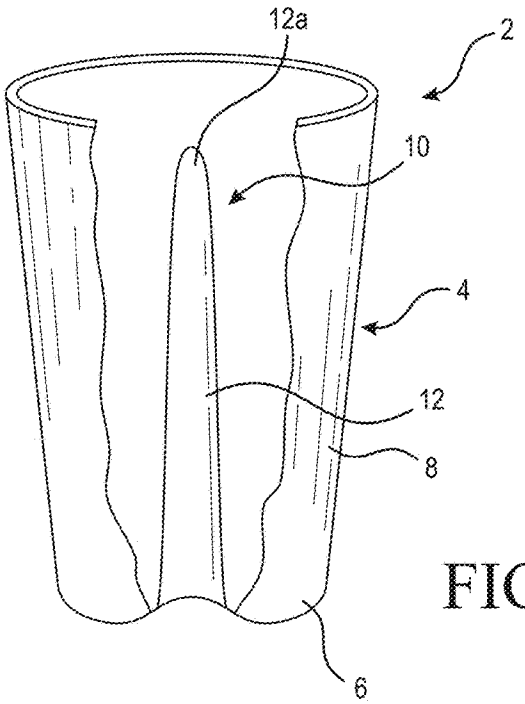
FIG. 1 is a partial cutaway perspective view of a container according to a first embodiment of the invention.
Figure 2:
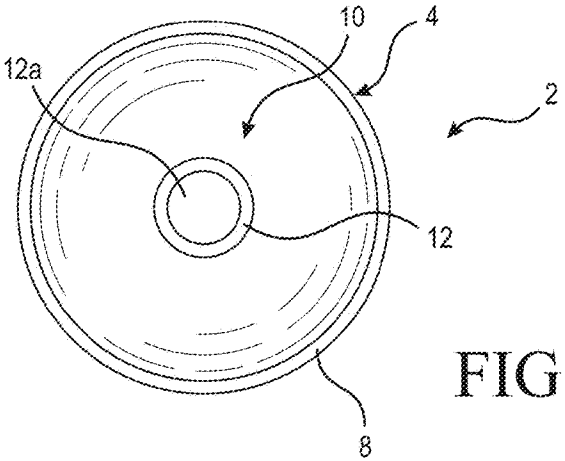
FIG. 2 is a top view of the container of FIG. 1.

The present invention relates broadly to containers, and more particularly to beverage containers such as glasses, cups, or pitchers made of any suitable material such as glass, synthetic plastic, or metal. Referring first to FIGS. 1 and 2, a first embodiment of the beverage container 2 according to the invention will be described.

The container is in the form of a housing 4 including a bottom wall 6 and a side wall 8 integral with the bottom wall. The housing is open at the upper end to define a chamber therein. The side wall preferably has a circular cross-sectional configuration, although other side wall geometric shapes may be used. A laminar flow device 10 is arranged within the chamber. In the embodiment of FIGS. 1 and 2, the laminar flow device is in the form of a projection 12 extending from a central portion of the bottom wall toward the housing upper end. The projection preferably has a conical configuration, the diameter of which progressively narrows in the direction of the housing upper end. In FIG. 1, the projection has a smooth outer surface and terminates at the upper end in a smooth dome 12*a*.

When a beverage is poured into the container, it preferably is deposited onto the projection 12 which directs the beverage toward the housing bottom wall with minimal turbulence. This is particularly important when carbonated beverages such as beer or soda are poured into the container. The laminar flow device is designed to minimize disruption or turbulence in the fluid. This minimizes foaming of the beverage within the container housing. To further minimize foaming, the bottom wall 8 has a concave configuration. As the beverage being poured or dispensed into the container travels down the laminar flow device 10, it smoothly passes over the curvature of the bottom wall to the side wall and gradually fills the container housing.

Figure 3:
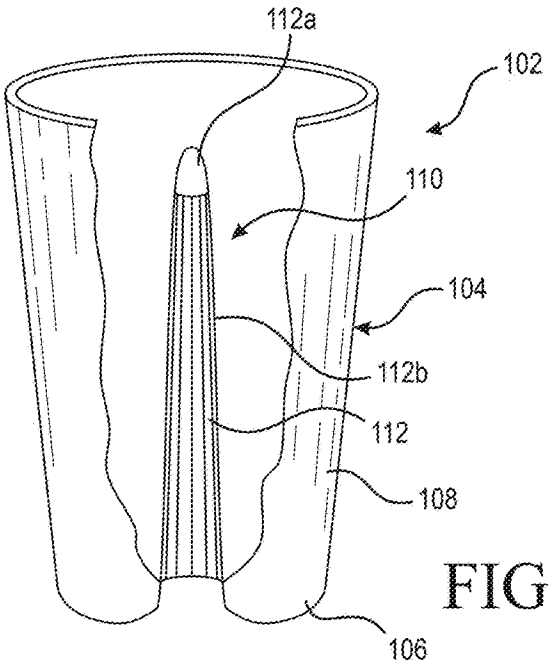
FIG. 3 is a partial cutaway perspective view of an alternate embodiment of the container of FIG. 1.
Figure 4:
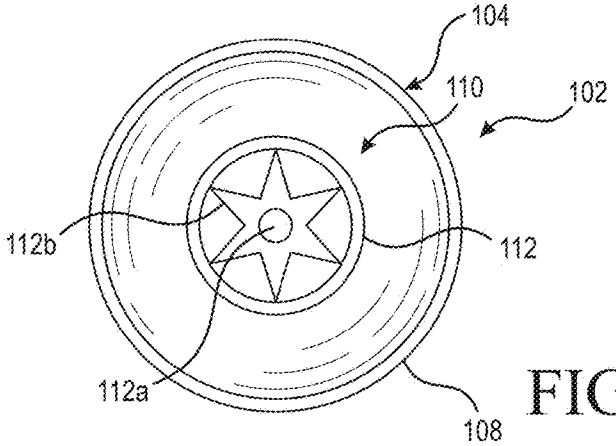
FIG. 4 is a top view of the container of FIG. 3.
Figure 5:
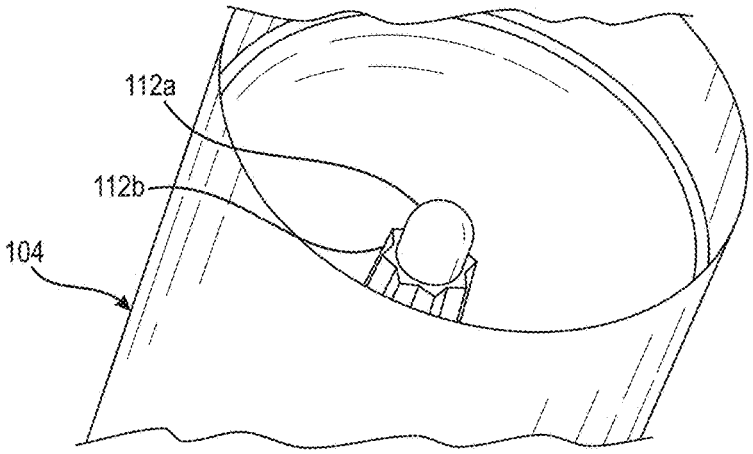
FIG. 5 is top perspective view of the container of FIG. 3.

Referring now to FIGS. 3-5, a preferred embodiment of the invention will be described. The container 102 of this embodiment is similar to that of FIGS. 1 and 2 in that it includes a housing 104 including a bottom wall 106, an integral side wall 108 and an internal laminar flow device 110. However, the projection 112 of the laminar flow device includes flutes 112*b* along a lower surface thereof. As shown in FIG. 4, the flutes preferably have a star-shaped configuration when viewed from above or in cross-section. Like the projection 12 in the embodiment of FIG. 1, the projection 112 is tapered, with the width of the projection narrowing in the direction of the upper open end of the housing. The upper end 112*a* of the projection 112 may be configured as a smooth dome as shown in FIG. 3, or the flutes may extend all the way to the top of the projection.

The fluted portion 112*b* of the projection in the preferred embodiment of FIGS. 3 and 4 increases the surface area of the projection. The increased surface area results in a more laminar flow. The stream of beverage being poured or dispensed into the housing contacts the fluted projection which slows the beverage down and causes a laminar flow of the beverage until it reaches the bottom wall 106. The slower stream of beverage delivered to the container bottom causes less foaming of the beverage.

Figure 6:
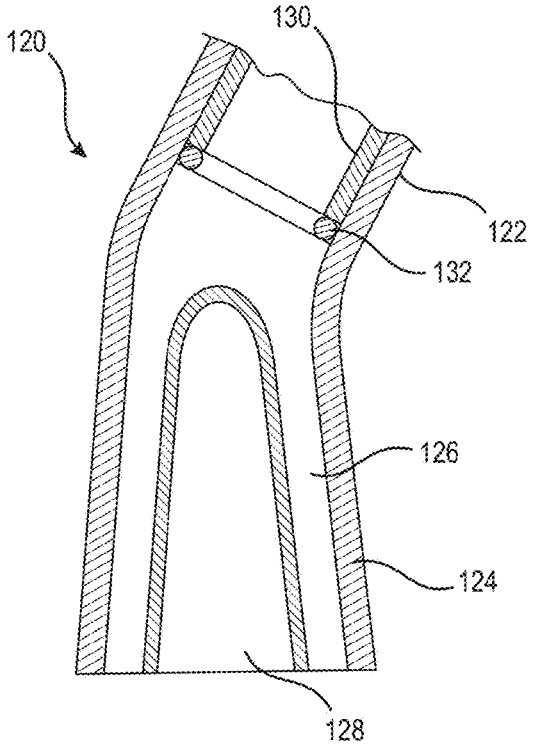
FIG. 6 is a sectional view of a flow director for a beverage dispenser according to the invention.
Figure 7:
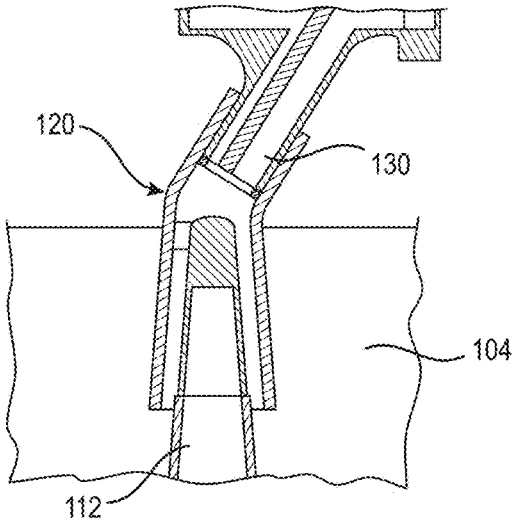
FIG. 7 is a partial sectional view of the flow director of FIG. 6 mounted on the container of FIG. 3 for dispensing fluid within the container.

The invention is particularly suitable for beer containers, mugs, cups, or pitchers because of the tendency of beer to foam when it is poured or dispensed into the container. Draft beer is typically dispensed from a keg via a tap. In order to direct the beer from the tap spout to the container, and particularly to the projection within the container, a flow director or fixture 120 such as shown in FIGS. 6 and 7 may be used. The fixture is open at its upper and lower ends 122, 124 with the upper end 122 preferably being arranged at an angle to the lower end. Within the lower end, the fixture contains an annular chamber 126. The open lower end 124 further contains a central opening 128 arranged within an inner circumference of the annular chamber as will be developed below.

The upper open end 122 of the fixture 120 is connected with the end of the tap spout 130 as shown in FIGS. 6 and 7. A gasket or washer 132 is provided within the fixture 120 to prevent leakage when the fixture is connected with the spout 130. The central opening 128 in the lower end of the fixture fits over the dome portion 112*a* of the projection 112 as shown in FIG. 7. The beer from the tap spout flows through the fixture 120 via the annular chamber 126 and down the projection 112. The fixture may include an interior fluted portion 120*a* as shown in FIG. 6 to fit over the fluted portion 112*b* of the projection.

It will be readily apparent to those of ordinary skill in the art that the fixture can also be used with the container in the embodiment of FIGS. 1 and 2, although interior flutes are not necessary for the fixture in such a situation. The fixture is formed of any suitable durable material such as synthetic plastic.

Figure 8:
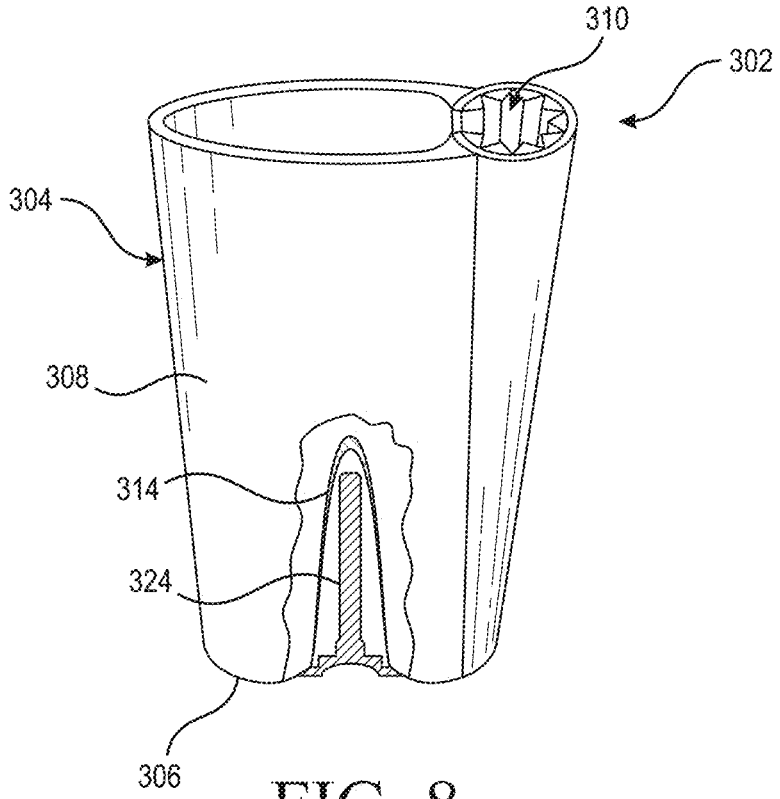
FIG. 8 is a partial cutaway view of a container according to another embodiment of the invention.
Figure 9:
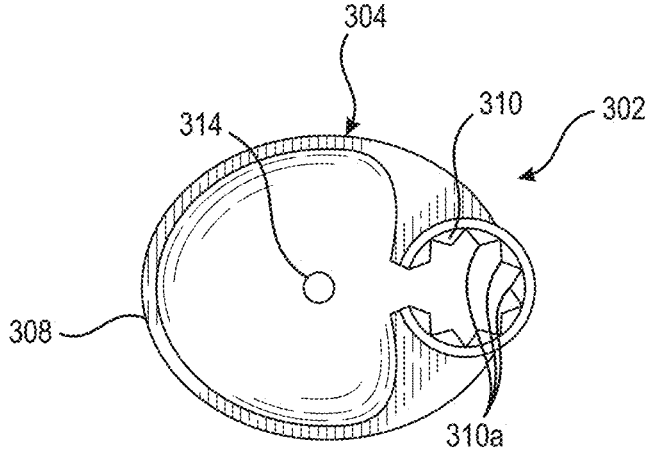
FIG. 9 is a top view of the container of FIG. 8.

A third embodiment of the invention is shown in FIGS. 8 and 9. In this embodiment, the container 302 also includes a housing 304 having concave bottom 306 wall and a side wall 308. However, the laminar flow device 310 of the container is arranged within an inner surface of the side wall. The device includes a fluted portion 310*a* of the inner wall surface. Preferably, the fluted portion of the inner wall surface is in the nature of a three-quarter tube which extends from the upper end of the housing down to the bottom wall 306. A poured beverage flows down the fluted tube which provides a laminar flow to minimize turbulence and foaming of the beverage.

A projection 314 may be provided within the housing chamber in the embodiment of FIGS. 8 and 9. The projection extends upwardly from the central portion of the concave bottom wall as in the embodiments of FIGS. 1-5, but need not extend all the way to the open upper end.

The centrally arranged projections in the housing may be hollow to allow the containers to be stacked. This is particularly true for container cups formed of synthetic plastic material.

Figure 10:
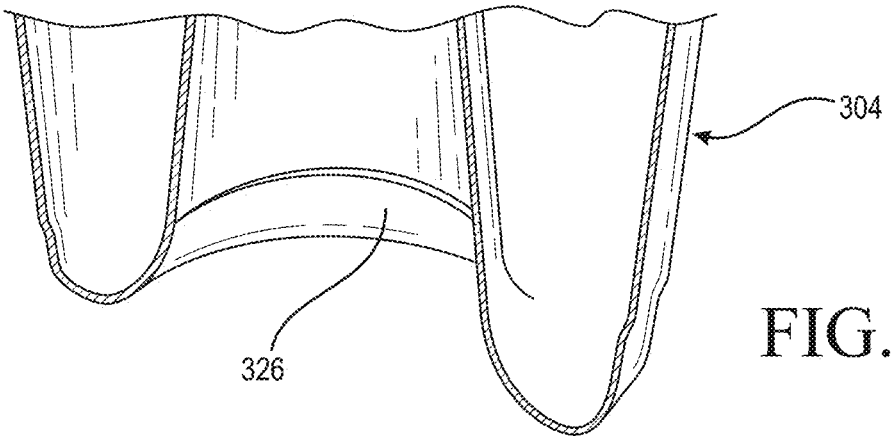
FIG. 10 is a partial perspective view of the concave bottom of a container according to a further embodiment of the invention.
Figure 11:
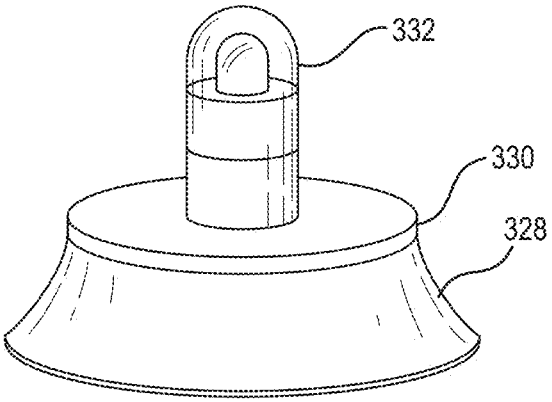
FIG. 11 is a front view of a light fixture for the container of FIG. 10.
Figure 12:
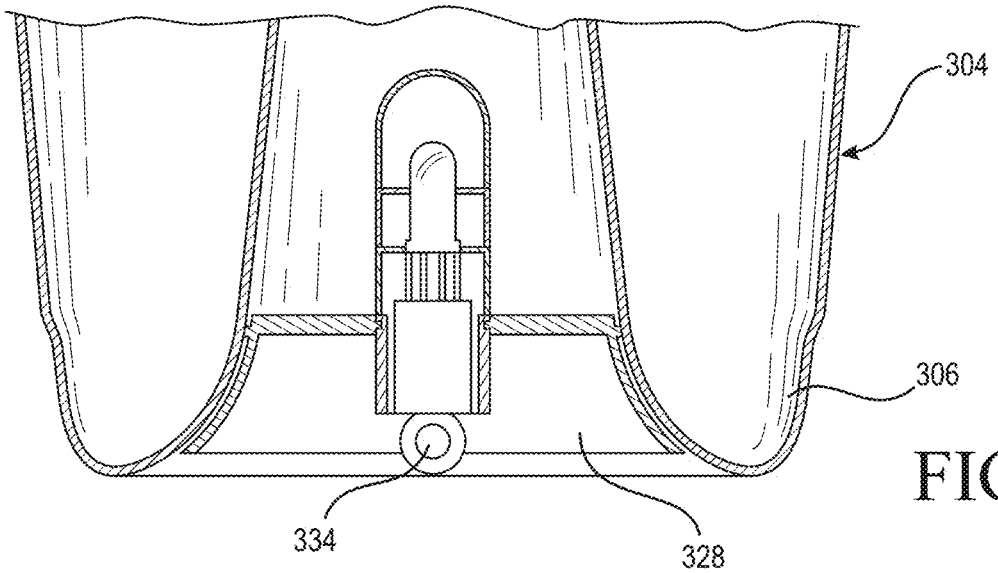
FIG. 12 is a partial sectional view of the container of FIG. 10 including the light fixture.

An illumination device 324 such as a glow stick may be arranged within the hollow projection to provide a unique visual appearance to the container. The illumination device is preferably removably connected within the projection. A preferred construction of the illumination device will be described with reference to FIGS. 10-12. The exterior surface of the central projection 314 which defines the hollow portion in the bottom of the container includes a continuous lip 326 as shown in FIG. 10. The illumination device includes a fixture 328 having an outer configuration which matches the configuration of the inner surface of the hollow portion of the projection. The fixture includes a recess 330 extending around the upper edge with is adapted to receive the lip 326 when the fixture is connected with the container within the hollow portion as shown in FIG. 12. The fixture holds a light bulb 332. A switch mechanism 334 extends beneath the fixture to operate the light bulb. The illumination device thus illuminates the interior of the container.

While the illumination device has been described for use with the container shown in FIGS. 8 and 9, it will be readily apparent that a similar device can be used with the containers of FIGS. 1-4.

The container has been described for use with pouring beverages, but it can also be used for any poured material including solids for filling large vessels.

While the preferred forms and embodiments of the invention have been illustrated and described, it will be apparent to those of ordinary skill in the art that various changes and modifications may be made without deviating from the inventive concepts set forth above.

What is claimed is:

1. A container, comprising (a) a housing having a bottom wall, at least one integral side wall, and an open upper end defining a chamber; and (b) a laminar flow projection having a fluted portion arranged within said chamber and extending from a central portion of said bottom wall for receiving a fluid being deposited into said chamber and directing said fluid toward said chamber bottom wall while minimizing turbulence within said fluid, whereby foaming of the fluid during filling of said chamber is minimized.

2. A container as defined in claim 1, wherein said laminar flow projection has a conical configuration of narrowing diameter in the direction of said housing upper end.

3. A container as defined in claim 2, wherein a lower portion of said laminar flow projection is fluted to increase a surface area thereof.

4. A container as defined in claim 3, wherein said fluted portion of said laminar flow projection has a star-shaped cross-sectional configuration.

5. A container as defined in claim 1, wherein said chamber bottom wall has a concave configuration.

6. A container as defined in claim 1, wherein said projection is hollow.

7. A container as defined in claim 6, and further comprising an illumination device removably connected within said hollow projection.

8. A container as defined in claim 1, and further comprising a flow director connected with a fluid source and configured to mate with said laminar flow projection to direct fluid from said source to said laminar flow projection to fill said housing.

9. A container, comprising (a) a housing having a bottom wall, at least one integral side wall, and an open upper end defining a chamber, wherein an inner surface of said side wall includes a fluted portion; and (b) a projection extending upwardly from a central portion of said bottom wall, whereby when a fluid is deposited into said chamber fluted portion and directed toward said chamber bottom wall, one of said fluted side wall inner surface and said projection minimizes turbulence within the fluid to minimize foaming of the fluid during filling of said chamber.

10. A container as defined in claim 9, wherein said fluted side wall inner surface has a star-shaped cross-sectional configuration.

11. A container as defined in claim 10, wherein said fluted portion has a narrowing diameter in the direction of said housing upper end.

12. A container as defined in claim 11, wherein said bottom wall has a concave configuration.

* * * * *